United States Patent [19]

Hsu

[11] Patent Number: 4,981,754

[45] Date of Patent: Jan. 1, 1991

[54] GLASS FIBERS HAVING A SIZE COMPOSITION CONTAINING THE REACTION PRODUCT OF AN ACID AND/OR ALCOHOL WITH THE TERMINAL EPOXY GROUPS OF A DIGLYCIDYL ETHER OF A BISPHENOL

[75] Inventor: Kuang-Hong Hsu, Newark, Ohio

[73] Assignee: Owens-Corning Fiberglas Corporation, Toledo, Ohio

[21] Appl. No.: 208,919

[22] Filed: Jun. 20, 1988

[51] Int. Cl.[5] ..... D04H 1/58

[52] U.S. Cl. ..... 428/288; 428/290; 428/361; 428/375; 428/378; 428/391; 428/392; 525/533; 525/523; 427/387; 427/389.8

[58] Field of Search ..... 428/392, 375; 525/533, 525/523; 560/107, 640, 641; 427/387, 389.8

[56] References Cited

U.S. PATENT DOCUMENTS

| | | | |
|---|---|---|---|
| 3,449,281 | 6/1969 | Sullivan et al. | 260/292 |
| 3,652,326 | 3/1972 | Ward | 117/126 |
| 3,920,313 | 11/1975 | Wong et al. | 428/373 |
| 4,065,417 | 12/1977 | Wong et al. | 260/17.4 |
| 4,104,434 | 8/1978 | Johnson | 428/273 |
| 4,110,094 | 8/1978 | Motsinger | 65/3 |
| 4,341,877 | 7/1982 | Das et al. | 523/409 |
| 4,424,316 | 1/1984 | DiSalvo | 525/528 |
| 4,448,910 | 5/1984 | Haines et al. | 428/378 |
| 4,454,197 | 1/1984 | Laganis et al. | 428/379 |
| 4,518,653 | 5/1985 | McWilliams et al. | 428/378 |
| 4,530,860 | 7/1985 | Johnson | 428/391 |
| 4,536,447 | 8/1985 | Hsu | 428/392 |
| 4,555,447 | 11/1985 | Sieloff et al. | 428/392 |
| 4,637,956 | 1/1987 | Das et al. | 428/391 |
| 4,783,509 | 11/1988 | Cavitt | 525/523 |

*Primary Examiner*—George F. Lesmes
*Assistant Examiner*—J. M. Gray
*Attorney, Agent, or Firm*—Patrick P. Pacella; Robert F. Rywalski

[57] ABSTRACT

Glass fibers are disclosed having the residue thereon of an aqueous size formulation in which the size formulation includes a film forming system which is substantially free of epoxy groups and which film forming system includes as a film forming material, a substantially fully reacted, preformed reaction product of a diglycidyl ether of a bisphenol or a partially or fully halogenated bisphenol with one or more monocarboxylic acids, one or more monohydric alcohols or mixtures thereof. The fibers are especially well adapted for producing cured polyester panels for use in greenhouses.

24 Claims, No Drawings

GLASS FIBERS HAVING A SIZE COMPOSITION CONTAINING THE REACTION PRODUCT OF AN ACID AND/OR ALCOHOL WITH THE TERMINAL EPOXY GROUPS OF A DIGLYCIDYL ETHER OF A BISPHENOL

TECHNICAL FIELD

The present invention is directed to glass fibers and more specifically glass fibers having a surface residue of an aqueous size composition. Fibers treated in accordance with the teachings of the present invention are ideally suited for use in reinforcing various polymeric matrices for example panels and particularly clear or translucent panels.

BACKGROUND ART

The reinforced plastic industry has been using glass fibers in various forms for reinforcing polymeric matrices to produce a wide variety of products. The glass fibers have been used in the form of continuous and chopped filaments, or strands, mats, rovings and various woven and nonwoven fabrics.

In producing glass fibers, for use as polymeric reinforcements, the glass fibers are attenuated from molten streams of fiberizable glass material flowing from a bushing which is connected to a furnace containing a pool of molten fiberizable glass. The glass fibers are typically attenuated by a winder which collects gathered filaments into a package or by rollers which pull the fibers before they are collected and chopped. In the process of producing glass fibers, a chemical treating composition is applied to the fibers shortly after they are attenuated from the molten stream of glass which emanates from the bushing.

The chemical treating composition is an aqueous composition, typically containing a film former system, coupling agents, lubricants, emulsifiers or surfactants and anti-static agents. The chemical treating composition, or size, is needed to retard interfilament abrasion of the glass fibers when they are gathered into a bundle or strand. In this way the high strength of the glass is helped to be maintained. The treating composition also makes the glass fibers compatible with polymeric matrices which they are ultimately intended to reinforce. In this respect the best results are attained when the film former is partially soluble in the pre-cured and predried version of the matrix polymer which the sized fiber is ultimately intended to reinforce. After the fiber is treated with the aqueous size formulation, the fibers typically are dried in the package form or in a chopped strand form before they are used for reinforcing polymeric matrices.

Clear or translucent plastic panels reinforced with glass fibers find application in solar collectors, skylights, patio covers, highway signs and markings and greenhouse glazings. Such panels are continuously produced by chopping glass rovings and forming a blanket of such chopped rovings on a plastic sheet, for example, Mylar material, while the sheet is moved on a conveyor. The rovings are then treated with a matrix resin, or binder, typically in the form of a solution of a thermosettable uncured polyester resin in styrene monomer. The resin impregnated roving blanket or mat is then coated with another sheet, for example, a Mylar sheet, and cured. The thickness of these panels is generally on the order of two or three millimeters to ten millimeters or more.

The sizes employed for coating fibers intended for use in producing plastic panels have certain unique demands upon them which are in addition to the general nearly universal requirements of a size. One additional requirement is that the sized glass fibers not reduce the weatherability of the panels and that high weather resistance be maintained for extremely long periods of time. Another requirement for such a size is that it must not allow the fibers to reduce the clarity of the panels with time. For example, if the size is not proper there is a tendency of the fibers to become very prominent, that is turn the panel white instead of maintaining the clear or transparent quality of the panels. Such whitening, of course, makes the panels unsuitable for their intended purpose as such as solar collectors, skylights, greenhouse glazings and the like. Another characteristic, of course, is that the sizes must render the fibers processable in the production of the panels. The size must not be so soft and tacky that the fibers will stick to each other upon being chopped; that is they must air disperse readily. Furthermore, the size on the glass fibers must have good wet out with the applied matrix resin; that is, the sized fibers must disperse readily in the polymeric resin matrix solution.

While many sizes have been employed there is nonetheless, a need in the art to provide improvements in the sizes so fibers will have qualities discussed above.

In accordance with the present invention glass fibers are provided with an improved size, the fibers thereby being well adapted for use in reinforcing numerous products, but especially being well adapted for forming panels. These fibers with their new size provide panels which have outstanding long term weatherability and clarity. The sizes likewise provide the fibers with a highly desirable attribute of dispersibility, both with regard to the chopping process and with regard to solution, or solvation, in the matrix resin.

DISCLOSURE OF THE INVENTION

The size composition, broadly and like the prior art, will include: a film forming system and; optionally, effective coupling amounts of a silane coupling agent; optionally, effective lubricating amounts of a lubricant; effective emulsifying amounts of one or more emulsifiers or surfactants; and, optionally, effective anti-static improving amounts of an anti-static agent. Unlike the sizes in the prior art the present size is free of epoxy resin; that is, the present size does not include any film forming material which contains substantial amounts of free, reactable epoxy, or oxirane groups. In accordance with the present invention at least one of the film forming materials of the film forming system is a substantially fully reacted, pre-formed reaction product of a diglycidyl ether of a bisphenol, or a halogenated bisphenol, with one or more monocarboxylic acids or with one or more monohydric alcohols or mixtures thereof. The monocarboxylic acid contemplated herein can also be an acid ester such as, that for example, produced by the reaction of an alcohol with an anhydride. Outstanding results are obtained by employing the diglycidyl ether of bisphenol A, or the diglycidyl ether of a halogenated, preferably brominated bisphenol A and, preferably, a bisphenol A which is fully substituted with bromine atoms.

If desired, the reaction with the monocarboxylic acid and monhydric alcohol can be done in the presence of isophthalic acid or adipic acid. Thus, when reference is made in the present specification, and claims, to reacting with a monocarboxylic acid or monohydric alcohol, this terminology contemplates within its scope that the reaction may likewise be done in the presence of isophthalic acid or adipic acid with the proviso, however, that the monocarboxylic acids and/or monohydric alcohols are present in amounts that dominate the properties of the reaction product. In other words, the reaction product is formed from a mixture consisting essentially of the diglycidyl ether and the acid/alcohol reactants. Typically the total amount of monocarboxylic acid employed (and/or the amount of the monohydric alcohol) will be in a molar ratio to isophthalic acid or adipic acid in excess of about 23:1.

The present invention contemplates the use in the size of a substantially fully reacted, preformed reaction product of the diglycidyl ether of a bisphenol or a halogenated bisphenol, preferably bisphenol A. This reaction product is preformed in the sense that it is formed prior to being combined into the aqueous size formulation by, first of all, substantially fully reacting the terminal epoxy rings so that the resulting reaction product is substantially free of unreacted epoxy rings.

In accordance with another feature of this invention, there is optionally included in the film forming system of the size composition effective film hardening amounts of other, non-epoxy, film forming polymers such as, for example, polyvinyl acetate or polyvinyl pyrrolidone.

As will be apparent from the above the film forming system contemplated herein is substantially free of unreacted, or reactable, epoxy groups. Thus the present film former is not an epoxy and it will be substantially more stable over long periods of time because the reactive epoxy group has been pre-reacted prior to inclusion in the size. There are, consequently, no longer any chemically reactive, or living, epoxy groups in the size which are available for later reaction when fibers with such coating are are exposed, for example, to temperatures convenient for epoxy reaction.

It will now be appreciated that one of the significant differences of the present invention compared to that disclosed in U.S. Pat. No. 4,518,653 or in U.S. Pat. No. 4,110,094 is that the film former system contemplated by the present invention is free of any resin or epoxy material having substantial amounts of reactable free epoxy groups therein. Similarly, the present contemplated reaction product will contain hydroxy ether or hydroxy ester terminal groups and not amino groups like those set forth in U.S. Pat. No. 3,449,291, and U.S. Pat. No. 3,920,313, U.S. Pat. No. 4,104,434 and U.S. Pat. No. 3,652,326. It will also be found that the film formers contemplated for use in the present invention are harder materials than amine-epoxy adduct type materials disclosed in these patents. Consequently, the present film former materials will generally be found to air-disperse more readily during and subsequent to the chopping process.

DETAILED DESCRIPTION OF THE INVENTION INCLUDING THE BEST MODE OF CARRYING THE INVENTION OUT

The preferred bisphenol-phenol employed in forming the fully reacted preform reaction product are the diglycidyl ethers of bisphenol A or the diglycidyl ethers of halogenated bisphenol A and preferably a bisphenol A structure which is substituted with bromine atoms. The preferred material is that generally designated below as Formula I wherein n has a value of desirably between about 0 to about 0.8 and preferably in excess of about 0.3. A highly preferred material is that commercially available from Dow Chemical Company under their designation DER-337. This material has a molecular weight of about 480 with n being about 0.34. Other desirable materials include EPON-834 and ARALDITE 6060. Another suitable material is that commercially available under the designation DER-542 wherein the structure is generally that as set forth in Formula I, but wherein each of the benzene rings are disubstituted with bromine atoms at the 3, 5 positions and the 3', 5' positions, respectively.

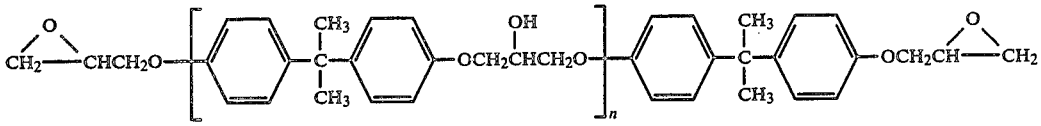

I

The present invention contemplates reaction of the terminal epoxy groups with an acid or an alcohol. Reaction II below summarily illustrates the reaction of the epoxy group with an acid to form a hydroxy ester terminal group, while Reaction III summarily shows the reaction of an epoxide group with an alcohol to form a hydroxy ether terminal group both as contemplated herein. In the preferred practice of the present invention a single monocarboxylic acid will be employed to substantially react with all of the available epoxide groups. Similarly, when an alcohol is employed a single monohydric alcohol will be used to react with substantially all of the epoxy groups. Of course, mixtures can be employed and, as indicated above, the reaction can be done in the presence of isophthalic acid or adipic acid, but the amount of such isophthalic acid or adipic acid must be limited so as to not detrimentally materially effect the desirable properties of the reaction product which result from using the monohydric and/or monocarboxylic acid reactants. In small amounts such material may in some instances help harden the formed film former but in large amounts the materials are detrimental because of the two reactable carboxy groups per molecule.

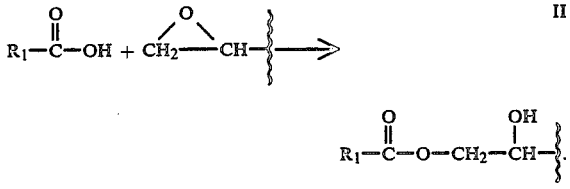

II

-continued

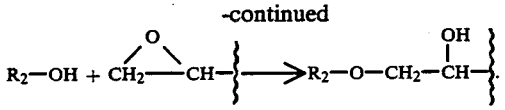

III

Structure IV below illustrates the reaction product of a mixture of monocarboxylic acids wherein one of the monocarboxylic acids is an acid/ester. In accordance with the structure set forth in Formula IV below, and which will be exemplified in greater detail in the Examples, the diglycidyl ether of bisphenol A is reacted with an $R_1$—COOH acid and with the reaction product of an alcohol ($R_3$—OH) with an anhydride such as, for example, a fully or partially halogenated phthalic anhydride like a tetrachloro substituted anhydride. As seen in Formula IV the resulting structure respectively shows terminal groups of a hydroxy ester in one instance and a hydroxy diester, the latter being the result of the reaction between the acid/ester and the epoxy groups. The term anhydride also contemplates and includes diacids unless there is a clear indication that a diacid is not to be employed. Diacids are less desirable, however, because more vigorous reaction conditions are needed.

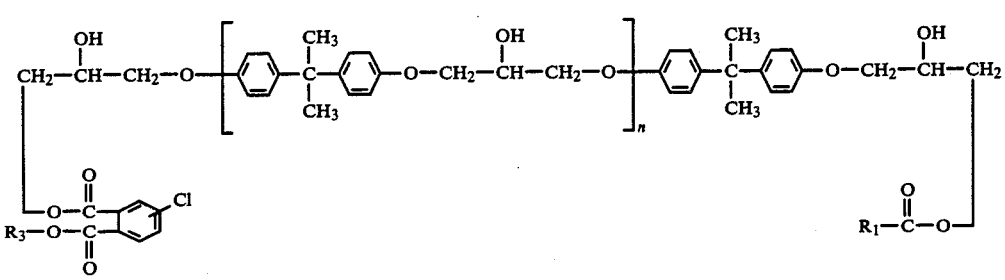

IV

The monocarboxylic acids and monohydric alcohols which will be found to be suitable for the practice of the present invention include acids of the structure $R_1$—COOH wherein $R_1$ is an organic or hydrocarbyl radical. Alcohols which will be found to be suitable are those of the Formula $R_2$—OH wherein $R_2$ is an organic or hydrocarbyl radical. Representative of the monocarboxylic acids which will be found satisfactory include the alkanoic acids, the alkenoic acids and aromatic acids. Suitably the acid will have one to nine carbon atoms with benzoic acid being preferred. The alcohol may be an alkanol, an alkenol, like allyl alcohol, or an aromatic alcohol. Suitably the alcohol will have 1 to 9 carbon atoms also. An exemplary anhydride which is employed to produce the half (partial) ester by reaction with an $R_3$—OH alcohol is tetrachlorophthalic anhydride. The anhydrides (including diacids) may be cyclic or aliphatic and they may be fully or partially substituted as, for example, by halogen atoms. Preferred anhydrides are cyclic anhydrides, either alicyclic or aromatic. These anhydrides may preferably contain from 6 to 9 carbon atoms. It will be found that desirable results will be obtained by employing a halogenated phthalic anhydride or chlorendic anhydride with a lower alkyl alcohol such as, for example, ethanol. $R_3$—OH may be any alcohol of the type described above for $R_2$—OH.

When evaluated with D-337 epoxy as the diglycidyl ether, it was found that formic acid, acetic acid and propionic acid produced a substantially fully reacted preformed reaction product which was somewhat on the soft and tacky side. Such material would be less preferred because other systems produced reaction products which were harder and thereby exhibited better air dispersion at the chopping operation. Benzoic acid and acrylic acid will generally be found to produce very good results but the dispersibility of the acrylic acid - epoxy adduct reaction product will be inferior. With respect to the alcohols, generally the more volatile alcohols are less preferred because of their volatility complicating the reaction process. Thus, for example, methanol and ethanol are less preferred than higher molecular weight alcohols. Representative of other acids and alcohols which may be used to form the reaction product film former are cinnamic acid and benzyl alcohol. Propanol, phenol, chlorinated phenols and allyl alcohol produce very good results.

The reaction to produce the substantially fully reacted, preformed reaction product of a diglycidyl ether of bisphenol, or a halogenated bisphenol, with the monocarboxylic acid and/or monohydric alcohol is preferably conducted in the presence of a non-reactive organic diluent. Exemplary of such diluents are toluene and xylene. Methyl ethyl ketone and/or diacetone alcohol may be added to the reaction product after synthesis to assist in emulsification. Additionally, it is preferred that the reaction be conducted in the presence of a catalyst, preferably a basic catalyst like an amine and most desirably a tertiary amine such as dimethylbenzylamine.

When an alcohol is employed as a reactant, it is preferred to use the alcohol in a substantial stoichiometric excess up to as much as 100% or even more molar excess alcohol. When an acid is employed it is preferred to use approximately stoichiometric amounts of material with a slight excess, on the order of a few percent, of the diglycidyl ether of bisphenol being satisfactory.

After the reaction to produce the substantially fully reacted, preformed film former reaction product the reaction product is emulsified and formed into the glass fiber size composition using conventional techniques. Generally an emulsion of about 40–60% by weight of solids in water (as 100% film former) will suitably be first prepared. Generally it has been found that cationic and anionic are less preferred than are the non-ionic emulsifiers, or surfactants. A tendency has been noted for the cationic and anionic surfactants, or emulsifiers, to reduce the solubility of the preformed film former material while on a glass surface in the matrix resin intended for utilizaiton in forming the panels, especially the uncured polyester-styrene solution. Such solubility reduction generally adversely impacts on the panel's weatherability.

While it is possible to conduct the synthesis to form the reaction product in the presence of the surfactant it is preferred to add the surfactant after synthesis of the fully reacted preformed reaction product. The emulsion is then simply formed by adding water to the surfactant bearing reaction product and agitating. While a host of non-ionic surfactants are available it is generally preferred to employ the Pluronic surfactants. The preferred surfactants are copolymers of ethylene oxide and propylene oxide. One suitable such non-ionic surfactant is Pluronic F-77 material. Representative of other suitable non-ionic surfactants are Pluronic F-108 and F-38 materials.

After formation of the emulsion the size is then formed. The size may include any of the numerous materials employed in sizes in the past. Thus, one or more silanes may be included, one or more lubricants, one or more anti-static agents and one or more additional surfactants.

In accordance with the preferred embodiment of the present invention, the size includes the substantially fully reacted, preformed reaction product as the film former optionally with an additional film former. The size will preferably include two silanes and will likewise include a quaternary ammonium salt as an anti-static agent. Exemplary of the optional film former that will be employed are polyvinyl pyrrolidone and polyvinyl acetate. These polymers are hard materials and provide enhanced dispersibility to the fibers at the chopping operation. As a general proposition in accordance with the preferred embodiment (on an anhydrous or 100% solids basis) the size will include about 3 to about 4% of a film former system, about 0.7 to about 1.5% of the silanes and about 0.08 to about 0.1% of the anti-static agent. Typically, the polyvinyl acetate and/or polyvinyl pyrrolidone when employed will be about 20 to about 40% by weight of the film forming system (on a 100% solid film former basis). Generally the size itself, on a total weight basis, will contain about 3% to about 5% solids, or nonaqueous material. The size is applied to the glass fibers to produce a coating of about 0.7% by weight (LOI) coating and fiber.

Preferably the silanes employed will be a mixture of A-174 silane and Z-6032 silane. A-174 silane is a gamma-methacryloxypropyltrimethoxy silane and Z-6032 is a vinyl benzyl amino functional trialkoxy silane. Other representative suitable silanes include alkyltrialkoxy silanes as well as other vinyl functional, methacryl functional, epoxy functional, mercapto functional, amino functional and ureido functional silanes.

Exemplary of suitable quaternary ammonium salts that are employed as an anti-static agent in accordance with the present invention are those set forth in U.S. Pat. No. 4,536,447. A particularly preferred anti-static agent is Larostat 264-A which is a soyadimethylethyl ammonium ethosulfate which is commercially available from the Jordan Chemical Company. If desired, the size composition may include conventional lubricants including, for example, mineral oils, anionic derivatives of long chain fatty acid dioctyl-phthalate, octylphenoxy-polyethoxyethanols and the like. Such materials are available commercially under the trade designations Twitchell 7440, DC 231, and Triton materials.

In the preferred use of the present invention the sized glass fibers will be employed to make panels in which the matrix resin is a thermoset polyester and in which the polyester is applied to the fibers as a liquid solution in styrene monomer. One such resin which is suitable is that commercially available from Owens-Corning Fiberglas Corporation under their designation E-410.

It has been observed that in order to obtain a panel with outstanding weatherability, the solubility parameter for the fully reacted, preformed reaction product film former of this invention in the resin matrix solution, e.g. curable polyester resin in a styrene solvent is an important parameter. It is a convenient tool for screening and selecting suitable film forming materials. Generally the preferred film formers have a solubility parameter (calculated or experimental) of about 10.4. More generally suitable panel weatherability characteristics will be obtained when the absolute difference between the solubility parameter of the film former on the glass and the solubility parameter of the uncured liquid resin system to be employed as the binder in the panel is on the order of about 0.5 or less. That is the difference can be plus or minus 0.5 for best results.

While the foregoing sets forth the present invention with sufficient particularity to enable those skilled in the art to make and use same, and includes the best mode contemplated in practicing the present invention, nonetheless further exemplification follows.

EXAMPLE I

The following will exemplify the synthesis of a substantially fully reacted preformed reaction product of a diglycidyl ether of bisphenol A with benzoic acid and the use of that film former in a size to coat glass fibers for panels.

The following reactants and the amounts indicated were employed in this example: dimethylbenzylamine catalyst (62 grams), DER-337 epoxy resin (epoxy equivalent weight of 240 - 43.94 pounds), benzoic acid (22.14 pounds), toluene (11.33 pounds), diacetone alcohol (10 pounds), Pluronic F-77 surfactant (10.1 pounds). The epoxy resin was first preheated to about 122° F. before use. The resin was then charged into a reactor followed by the charging of about 17.7 pounds of the benzoic acid. These ingredients were then mixed for approximately 10 minutes. The agitation was then stopped and the remainder of the benzoic acid was then added followed by the charging of 1.33 pounds of the toluene and the tertiary amine catalyst. Agitation was begun and the reactor was heated to about 320° F. The temperature of the ingredients was then allowed to reach 374° F. It should be noted that care should be exercised at this point because there is a sudden exotherm and cooling will typically be required to maintain the temperature at about 374° F. The reactor temperature was cooled to about 320° F. and maintained at that temperature. The acid value was periodically checked until it reached a value of between about 0.5 to about 1.0. At this point, in order to form a solution of the substantially fully reacted reaction product and aid in emulsification, 10 pounds of the diacetone alcohol was added with good mixing while cooling. The Pluronic F-77 emulsifier was then added along with 10 pounds of toluene. This was done approximately at the point where the resin temperature was at about 210° F. The substantially fully reacted preformed reaction product along with the surfactant and the solvent was then cooled to about 100° F. and drained through a filter. This solution was about 78% by weight solids (reaction product and emulsifier).

About 67.48 parts by weight of the substantially fully reacted preformed reaction product organic solution from above was combined with 38 parts of water and agitated to produce an emulsion of about 50% by weight solids.

Using conventional techniques, a size was produced using approximately 393.3 pounds of the above emulsion, 14.9 pounds A-174 silane, 16.9 pounds of Z-6032 silane, about 4.06 pounds of glacial acetic acid, about 3.38 pounds of Larostat 264-A anti-static agent and about 6957 pounds of deionized water. The pH of the aqueous size was approximately 4 and the solids were about 3% by weight.

Using conventional techniques the size was applied onto E-glass fibers (about 0.6% by weight of strand solids) and the formed packages dried and then converted into rovings. Rovings were then chopped in a conventional manner and converted into panels employing an unsaturated polyester resin in a styrene solution (available from Owens-Corning Fiberglas Corporation under their designation E-410). The cured panels had a thickness on the order of about 3 millimeters to about 5 millimeters. In chopping the fibers it was observed that the size coating although providing dispersibility showed some sticking. Additionally, the film former in the size showed good solubility in the unsaturated polyester resin solution and exhibited good wet out. The above produced panels were then immersed and held in boiling water for about 2 hours after which visible light transmission was measured. Typically the light transmission of these panels prior to boiling water immersion was about 90–93%. After immersion in boiling water the panel showed no significant change, namely the transmission was about 90 to about 91% or so, thus indicating good weatherability. Additionally, the clarity of the panels was not jeopardized during the boiling water test. Commercial panels using a different size formulation and different film former showed visible light transmissions after boiling between 65 or 75% up to about 85%.

EXAMPLE II

Example I was substantially duplicated with the exception that in addition to employing the substantially fully reacted, preformed reaction product of benzoic acid with the diglycidyl ether of bisphenol A as a film former, the film former system also included polyvinyl acetate (National Starch Product designation 1971 - 25). In producing such sizes the polyvinyl acetate is added along with the silanes, acetic acid, and quaternary ammonium salt when the size is formulated. The polyvinyl acetate was substituted for a portion of the film forming reaction product. Good results were obtained by employing about 20% to about 40% by weight of polyvinyl acetate in the film forming system (and about 60% to about 80% by weight of the fully reacted preformed reaction product film former material). When employing the polyvinyl acetate it has been observed that the same outstanding weathering results are obtained but the size coating on the fibers is slightly harder. This provides less sticking and improved dispersion of the strands during chopping.

EXAMPLE III

Example I was substantially duplicated except that, during the synthesis of the substantially fully reacted preformed reaction product of benzoic acid with the diglycidyl ether of bisphenol A, small amounts of isophthalic acid were substituted for some of the benzoic acid and, in addition to toluene, methyl ethyl ketone was employed as a solvent. On a weight basis the charge of ingredients included about 46.9% by weight of the DER-337, about 21.13% by weight of benzoic acid, about 14% by weight of ketone, about 10.49% by weight of diacetone alcohol, and about 5.6% by weight of toluene, about 1.36% by weight of isophthalic acid and about 0.15% by weight of dimethylbenzyl amine. The ketone, like the diacetone alcohol was added after synthesis to enhance emulsification.

Substantially identical results as those obtained in Example I were realized except the film former may have been a little harder.

EXAMPLE IV

In a generally similar to that of Example I (except in smaller quantities) formic acid, acetic acid, propanoic acid and acrylic acid were employed as the monocarboxylic acid. The molar amounts were substantially the same as in Example I. Generally the ultimate panels performed well especially with regard to weatherability. It was observed that the fibers coated with the substantially fully reacted, preformed reaction product of the epoxy and formic acid, acetic acid and propanoic acid, respectively, had a somewhat softer coating and exhibited a slightly increased tendency towards sticking during chopping. The hardness of such size coatings may, as indicated above, be increased and the chopping dispersibility thereby likewise increased by incorporating into the size formulation, as part of the film forming system, effective hardness improving amounts of polyvinyl acetate and/or polyvinyl pyrrolidone. The acrylic acid reaction product gave substantially the same outstanding results as benzoic acid reaction product although dispersibility was inferior.

EXAMPLE V

The following generally illustrates the use of a reaction product in which a mixture of monocarboxylic acids are employed and in which one of the monocarboxylic acids is an acid/ester.

Into a reactor there was added about 287 grams of tetrachloro phthalic anhydride and about 51 grams of ethyl alcohol. With mixing, the mixture was heated under reflux to the boiling point of ethanol and held there for about 20 minutes. This mixture was then heated to about 120° C. and held there for about 30 minutes. About 60 grams of glacial acetic acid, about 384 grams of DER-331 (epoxy equivalent weight of 192) and about 3 grams of dimethylbenzyl amine were added. DER-331 is represented by Formula I above, wherein n is 0 with the material thereby having a molecular weight of about 384. These ingredients were then allowed to react at about 120° C. for about 3 hours and then about 100 grams of the Pluronic F-77 surfactant was added and the reaction mass cooled to about 70° C. at which time about 100 grams of toluene were added. The solution of the film former was allowed to cool to about room temperature and then an emulsion was made from this entire mass of solution by combining it with about 872 grams of water thereby producing an emulsion of about 50% by weight solids (film former and surfactant).

A size was manufactured by employing about 432 grams of the above emulsion, 22 grams of A-174 silane, about 25 grams of Z-6032 silane, about 5 grams of Larostat 264A quaternary ammonium salt, about 6 grams of acetic acid and about 6010 grams of deionized water. This size formulation was applied to glass fibers which, in turn, were dried formed into rovings and then the rovings used to produce panels as generally described above. After boiling in water for two hours the panels showed a visible light transmission of about 91.8% maximum (with a typical range being 90 to about 91%)

Substantially identical results are obtained by substituting 1,4,5,6,7,7-hexachlorobicyclo-(2,2,1)-5heptene-2,3-dicarboxylic anhydride) in substantially equal molar quantities for the tetrachlorophthalic anhydride.

EXAMPLE VI

Substantially fully reacted preformed reaction products of a diglycidyl ether of bisphenol A with various alcohols and phenols were prepared to produce the corresponding hydroxy ether materials. The alcohols employed included n-propanol, allyl alcohol, phenol and pentachloro phenol. The general procedure for this evaluation was as set forth in Example I but DER-331 epoxy was used. Unlike Example I wherein a slight stoichiometric excess of the epoxy functionality was employed, when using the alcohols a large stoichiometric excess is employed. Preferably the alcohols are employed in about 100% molar excess, that is, for each reactive epoxy group two moles of alcohol are employed. Additionally, prior to adding the solvents to finally form the film former organic solution the excess unreacted alcohol is first stripped off.

Panels formed from fibers which have been coated with a size containing the film former which was the reaction product of propanol and allyl alcohol and pentachloro phenol showed light transmissions in excess of 90% after the boiling water test. The film former which was the reaction product from phenol showed light transmission values of about 85%.

The air dispersibility of fibers coated with the phenolic reaction products were superior to those coated with the propanol and allyl alcohol film former systems.

The results, both with regard to dispersibility and weathering, when employing DER-542 resin instead of DER-337 as in Example I were both very good. DER-542 resin may be viewed as that represented by Formula I above wherein n is 0 and where the bisphenol A carries 3,5 and 3', 5' tetrabromo substitution.

When employing sizes in which the film former was formed from EPON-836 (600 molecular weight) and reacted with benzoic acid it was found that such film formers are generally less preferred than those set forth above with respect to weatherability. Thus, the highly preferred materials are the DER materials where n in Formula I above ranges between about 0.34 to about 0.76.

While the above describes the present invention, it will, of course, be apparent that modifications are possible which pursuant to the patent statutes and laws do not depart from the spirit and scope thereof.

I claim:

1. An article comprising glass fibers having a size coating thereon, said coating comprising one or more film forming materials, wherein at least one of said materials is a substantially fully reacted, preformed reaction product of a diglycidyl ether of a bisphenol or halogenated bisphenol with a sufficient amount to react with substantially all epoxy groups of said diglycidyl ether, of a monocarboxylic acid or a monohydric alcohol, or mixture of one or more of such acids or alcohols optionally in the presence of isophthalic acid or adipic acid, and wherein said film forming materials are substantially free of materials containing free reactive epoxy functionality, and wherein said substantially fully reacted reaction product is free of amine-epoxy reaction product functionality and contains hydroxy ester or hydroxy ether reaction product functionality.

2. The article of claim 1 wherein said at least one of said film forming materials is a substantially fully reacted, preformed reaction product of said diglycidyl ether and benzoic acid.

3. The article of claim 1 wherein said at least one of said film forming materials is a substantially fully reacted, preformed reaction product of said diglycidyl ether and a mixture of acetic acid and the acid/ester reaction product of ethyl alcohol with a chloro-substituted phthalic anhydride or with chlorendic anhydride, and wherein said article is a weather resistant reinforced panel.

4. The article of claim 1 wherein said at least one of said materials is a substantially fully reacted, preformed reaction product of propanol, allyl alcohol, phenol or chlorinated phenol with said diglycidyl ether, and wherein said article is a weather resistant reinforced panel.

5. The article of claim 1 wherein said article is a clear or translucent, whitening-resistant, weather resistant reinforced panel and wherein said fibers are chopped fibers.

6. The panel of claim 5 wherein said panel comprises a polyester matrix.

7. The panel of claim 5 wherein said preformed reaction product is formed from a monocarboxylic acid and wherein said monocarboxylic acid is acrylic acid.

8. The panel of claim 5 wherein said diglycidyl ether is the ether represented by Formula I and wherein n is between 0 to about 0.8.

9. The panel of claim 5 wherein said substantially fully reacted preformed reaction product is the reaction product of a monocarboxylic acid, or mixtures thereof, having 3 to 7 carbon atoms with said diglycidyl ether.

10. The panel of claim 9 wherein said acid is benzoic acid, acrylic acid or propionic acid.

11. The panel of claim 5 wherein said monocarboxylic acid, or mixtures thereof, employed in forming said reaction product includes an acid ester reaction product of a monohydric alcohol with an alicyclic or aromatic anhydride.

12. The panel of claim 11 wherein said monocarboxylic acid is a mixture of acetic acid and the reaction product of said monohydric alcohol and anhydride and further wherein said anhydride is chlorophthalic anhydride or chlorendic anhydride.

13. The panel of claim 5 wherein said substantially fully reacted preformed reaction product is the reaction product of a monohydric alcohol, or mixtures thereof, and wherein said monohydric alcohol is a saturated or unsaturated alcohol having 3 to 6 carbon atoms.

14. The panel of claim 13 wherein said monohydric alcohol is phenol, chlorinated phenol, propanol or allyl alcohol.

15. The panel of claim 5 wherein said diglycidyl ether has a molecular weight of about 480 to about 600.

16. The panel of claim 5 wherein said size coating further includes one or more film forming materials selected from the group consisting of polyvinyl acetate and polyvinyl pyrrolidone, said materials being employed in effective anti-tack enhancing amounts.

17. The panel of claim 16 wherein said size coating includes polyvinyl acetate.

18. The article of claim 1 wherein said article comprises said glass fibers in an uncured resin matrix solution of a curable polyester resin in a styrene solvent and wherein the absolute difference between the solubility parameter of the film former on the glass and the solubility parameter of the resin matrix solution is less than about 0.5.

19. Glass fibers containing a dried residue of an aqueous size composition on their surface said size composition including a film former system which is free of an epoxy resin and which includes a preformed substantially fully reacted reaction product of a diglycidyl ether of bisphenol A or a halogenated bisphenol A with a sufficient amount of a monocarboxylic acid, or a monohydric alcohol, optionally in the pressure of isophthalic acid or adipic acid, or mixture of one or more of such acids and alcohols, to react with substantially all epoxy groups of said diglycidyl ether and wherein said substantially fully reacted reaction product is free of amine-epoxy reaction product functionality and contains hydroxy ester or hydroxy ether reaction product functionality.

20. The glass fibers of claim 19 wherein said size composition optionally includes at least one organo silane in effective coupling amounts, optionally polyvinyl acetate or polyvinyl pyrrolidone in effective anti-sticking amounts, optionally an anti-static agent in effective anti-static improving amounts, and a surfactant in effective emulsifying amounts and wherein said fibers are chopped.

21. The fibers of claim 19 wherein said size includes the reaction product of an ether represented by Formula I wherein n is about 0.34 and benzoic acid, said size further includes a mixture of a methacryloxypropyl silane and a vinyl benzyl amine functional silane and a quaternary ammonium salt anti-static agent.

22. The glass fibers of claim 19 wherein said glass fibers are chopped glass fibers.

23. A method of producing glass fibers which comprises substantially completely reacting the epoxy groups of a diglycidyl ether of bisphenol A or a halo bisphenol A with a monocarboxylic acid or a monohydric alcohol or mixtures thereof, optionally in the presence of isophthalic acid or adipic acid, to produce a film forming reaction product which is free of amine-epoxy reaction product functionality and which contains hydroxy ester functionality when a monocarboxylic acid is employed and which contains hydroxy ether functionality when a monohydric alcohol is employed; incorporating said film forming reaction product into an aqueous based size emulsion, said size emulsion being substantially free of film forming materials having free epoxy groups and applying said emulsion to a glass fiber surface.

24. The method of claim 23 wherein said aqueous size includes on or more organo silane coupling agents and an anti-static agent.

* * * * *